US006026513A

United States Patent [19]

Sima

[11] Patent Number: 6,026,513

[45] Date of Patent: Feb. 22, 2000

[54] MANICURE GLOVE DEVICE FOR WEARING ON THE HAND OF A USER THEREOF

[76] Inventor: Elizabeth Sima, 10E. Ontario. Apartment #1101, Chicago, Ill. 60611

[21] Appl. No.: 09/193,075

[22] Filed: Nov. 16, 1998

[51] Int. Cl.[7] ..... A41D 19/00

[52] U.S. Cl. ..... 2/163; 2/167; 132/73

[58] Field of Search ..... 2/21, 159, 161.1, 2/161.3, 163, 167; 132/73

[56] References Cited

U.S. PATENT DOCUMENTS

| | | | |
|---|---|---|---|
| 3,128,472 | 4/1964 | Raney | 2/161.1 |
| 4,089,066 | 5/1978 | Dethman | 2/21 |
| 4,972,857 | 11/1990 | Stewart et al. | 132/73 |
| 5,269,720 | 12/1993 | Moretz | 450/37 |
| 5,282,276 | 2/1994 | Preziose | 2/21 |
| 5,500,956 | 3/1996 | Schulkin et al. | 2/139 |
| 5,575,008 | 11/1996 | McBride et al. | 2/161.1 |
| 5,577,521 | 11/1996 | Neitlich | 132/285 |
| 5,598,584 | 2/1997 | DaGrossa | 2/159 |
| 5,768,711 | 6/1998 | Wissink | 2/161.1 |

OTHER PUBLICATIONS

Lycra for Swim, Activewear, Skating and Dance (Internet Science), Mar. 16, 1999.

*Primary Examiner*—Diana Oleksa
*Assistant Examiner*—Katherine Moran
*Attorney, Agent, or Firm*—David J. Archer

[57] ABSTRACT

A manicure glove device for wearing on the hand of a user thereof the device including a main portion for accommodating the palm of the hand and a plurality of finger portions extending from the main portion, each finger portion of the plurality of portions having a proximal and a distal end for receiving therein a finger of the hand. Each of the distal portions defines an opening such that a fingernail of the finger protrudes therethrough Also, the glove device is fabricated from a piece of stretchable fabric.

11 Claims, 1 Drawing Sheet

MANICURE GLOVE DEVICE FOR WEARING ON THE HAND OF A USER THEREOF

BACKGROUND OF THE INVENTION

1. Field of the invention.

The present invention relates to a manicure glove device for wearing on the hand of a user thereof.

More specifically, the present invention relates to a fingerless manicure glove device for wearing on the hand of a user during and after a manicure procedure for assisting in the drying and curing of a manicure.

2. BACKGROUND INFORMATION

When a manicure has been completed, the materials applied to the nails require several hours to completely dry and cure.

In an attempt to speed up the curing process, various ultra-violet light devices have been devised. Such ultra violet devices usually include a light box having an opening for the reception therein of the client's manicured fingers. When the client who has received a manicure is thus irradiated with ultra violet light, the curing of the manicure is accelerated.

However, such prior art arrangements suffer from several drawbacks. Firstly, the chemicals used during the manicure react to the ultra violet light to produce a vapor that has an objectionable odor.

Secondly, such ultra violet treatment necessitates the provision in a manicure salon of several units for the treatment of clients thereby contributing to an increase in the overall cost of such manicure.

Additionally, although such ultraviolet light treatment is relatively rapid, such treatment nevertheless requires supervision by trained manicure staff thus further increasing the cost of running a manicure salon.

The present invention overcomes the aforementioned problems associated with the prior art arrangements by the provision of special fingerless gloves which are worn by the client before the polishing process. Such gloves remain worn by the client after the manicure during curing of the materials applied to the client's nails.

Exposure of treated nails to low temperatures is known to rapidly cure the applied material. Therefore, the fingerless gloves not only insulate the wearer's hands from inclement weather conditions but more importantly, at the same time expose the user's nails to the cold for rapid curing of the manicure.

Therefore, it is a primary objective of the present invention to provide gloves which overcome the aforementioned problems associated with the prior art curing arrangements and to provide a device which makes a considerable contribution to the art of manicuring nails.

Other objects and advantages of the present invention will be readily understood by those skilled in the art by a consideration of the detailed description of a preferred embodiment of the present invention contained hereinafter taken in conjunction with the annexed drawings.

SUMMARY OF THE INVENTION

The present invention relates to a manicure glove device for wearing on the hand of a user thereof. The glove device includes a main portion for accommodating the palm of the hand and a plurality of finger portions extending from the main portion. Each finger portion of the plurality of portions has a proximal and a distal end for receiving therein a finger of the hand.

Each of the distal portions defines an opening such that a fingernail of the finger protrudes therethrough. Also, the glove device is fabricated from a piece of stretchable fabric.

In a more specific embodiment of the present invention, the main portion includes a first and a second end and a first and a second side.

The first end of the main portion defines an aperture for the insertion therein of the hand of the user.

The plurality of finger portions extend from the second end of the main portion and the first side of the main portion includes a seam.

A thumb portion extends from the main portion, the thumb portion having a first and a second extremity for receiving therein a thumb of the hand.

The second extremity of the thumb portion defines an orifice such that a thumbnail of the thumb protrudes therethrough. The thumb portion is disposed adjacent to the second side of the main portion.

The plurality of finger portions are integral with the main portion, the main portion and the plurality of finger portions being fabricated from the piece of stretchable fabric.

A further seam is provided for securing the thumb portion to the main portion, the thumb portion being fabricated from a further piece of the stretchable fabric.

Each finger portion of the plurality of finger portions further includes a first and a second seam. Each of the first and second seams extend from the proximal to the distal end of the finger portion.

The piece of stretchable fabric is a fabric which is stretchable in a first and second direction, the first and second directions being opposite to each other. The fabric is also stretchable in a third and a fourth direction, the third and fourth directions being opposite to each other. The first and second directions are normal to the third and fourth directions.

The piece of stretchable fabric includes a polyester within the range 85–95 by weight and a spandex within the range 15–5% by weight. Preferably, the material is 90% poly and 10% Spandex having a weight of 420 grams. The cloth is cut from rolls 58–60" in width.

Also, the further piece of stretchable fabric includes a polyester within the range 85–95% by weight and a spandex within the range 15–5% by weight.

The piece of stretchable fabric is cut from a source of material which is preferably within the range 58–60 inches in width and within the range 58–62 inches in length.

Similarly, the further piece of stretchable fabric is cut from a source of material which is within the range 58–60 inches in width and within the range 58–62 inches in length.

Additionally, the piece of stretchable fabric and further piece of stretchable fabric are cut from a source of material which is velvet.

Many modifications and variations of the present invention will be readily perceived by those skilled in the art by a consideration of the preferred embodiment shown in the annexed drawings and as described in the detailed description contained herein. However, such modifications and variations fall within the spirit and scope of the present invention as define by the appended claims.

DETAILED DESCRIPTION OF THE DRAWINGS

Figure 1:
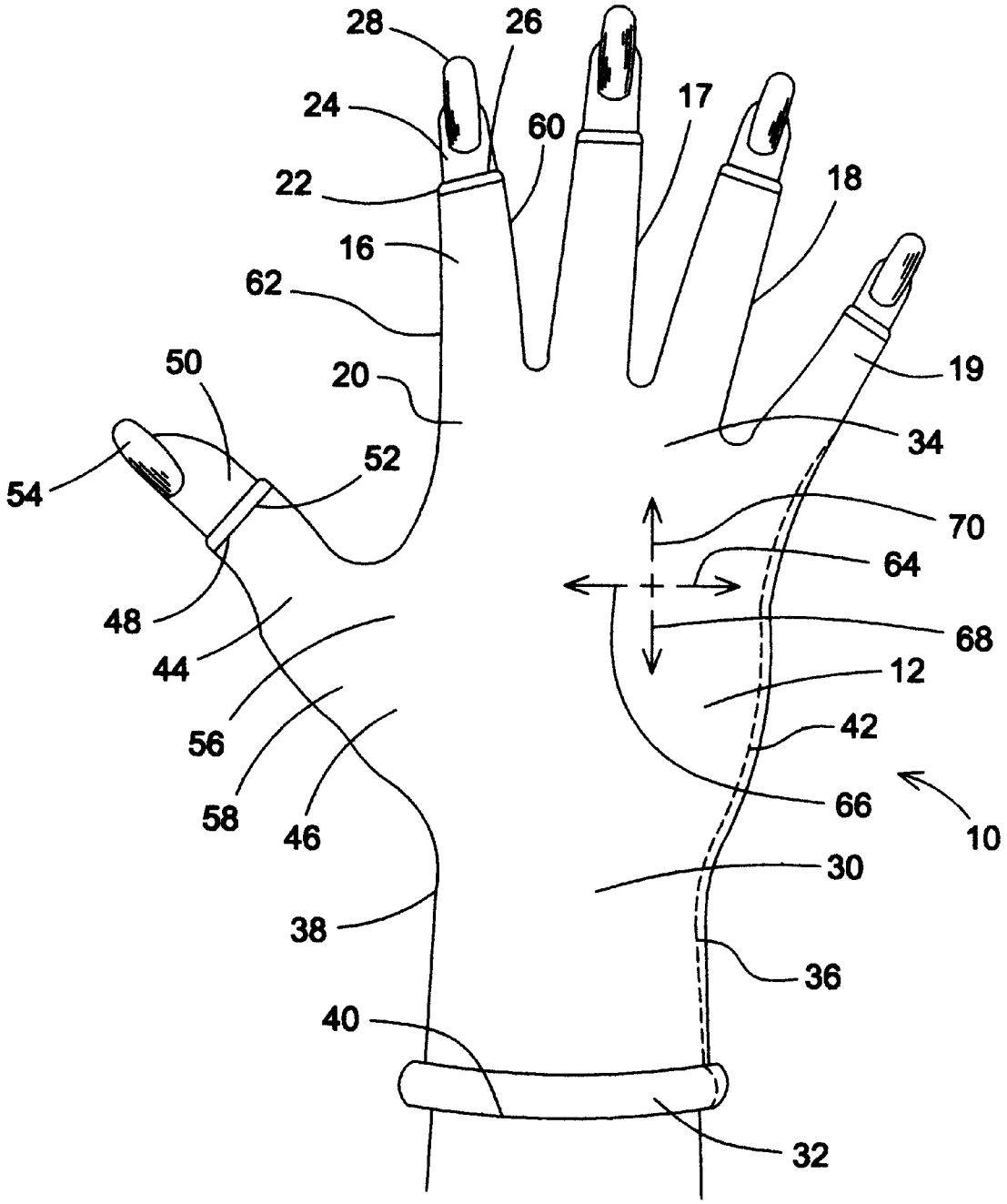
FIG. 1 is a top plan view of one of a pair of gloves according to the present invention.

FIG. 1 is a top plan view of a glove generally designated 10 of a pair of gloves according to the present invention.

The manicure glove device 10 shown in FIG. 1 is for wearing on the hand 12 of a user thereof. The glove device 10 includes a main portion 14 for accommodating the palm of the hand and a plurality of finger portions 16, 17, 18 and 19 extending from the main portion 14. Each finger portion as for example finger portion 16 of the plurality of portions 16–19 has a proximal and a distal end 20 and 22 respectively for receiving therein a finger 24 of the hand 12.

Each of the distal portions 22 define an opening 26 such that a fingernail 28 of the finger 24 protrudes therethrough. Also, the glove device 10 is fabricated from a piece 30 of stretchable fabric.

In a more specific embodiment of the present invention, the main portion 14 includes a first and a second end 32 and 34 respectively and a first and a second side 36 and 38 respectively.

The first end 32 of the main portion 14 defines an aperture 40 for the insertion therein of the hand 12 of the user.

The plurality of finger portions 16–19 extend from the second end 34 of the main portion 14 and the first side 36 of the main portion 14 includes a seam 42.

A thumb portion 44 extends from the main portion 14, the thumb portion 44 having a first and a second extremity 46 and 48 respectively for receiving therein a thumb 50 of the hand 12.

The second extremity 48 defines an orifice 52 such that a thumbnail 54 of the thumb 50 protrudes therethrough.

The thumb portion 44 is disposed adjacent to the second side 38 of the main portion 14.

The plurality of finger portions 16–19 are integral with the main portion 14, the main portion 14 and the plurality of finger portions 16–19 being fabricated from the piece 30 of stretchable fabric.

A further seam 56 is provided for securing the thumb portion 44 to the main portion 14, the thumb portion 44 being fabricated from a further piece 58 of the stretchable fabric.

Each finger portion such as 16 of the a plurality of finger portions 16–19 farther includes a first and a second seam 60 and 62 respectively. Each of the first and second seams 60 and 62 extend from the proximal end 20 to the distal end 22 of the finger portion 16.

The piece 30 of stretchable fabric is a fabric which is stretchable in a first and second direction as indicated by the arrows 64 and 66 respectively. The first and second directions 64 and 66 are opposite to each other. The fabric is also stretchable in a third and a fourth direction as indicated by the arrows 68 and 70 respectively. The third and fourth directions 68 and 70 are opposite to each other. Also, the first and second directions 64 and 66 are normal to the third and fourth directions 68 and 70.

Preferably, the piece 30 of stretchable fabric includes a blend of a polyester within the range 85–95% by weight and a spandex within the range 15–5% by weight.

Also, the further piece 58 of stretchable fabric includes a polyester within the range 85–95% by weight and a spandex within the range 15–5% by weight.

The piece 30 of stretchable fabric is cut from a source of material which is preferably within the range 58–60 inches in width and within the range 58–62 inches in length.

Similarly, the further piece 58 of stretchable fabric is cut from a source of material which is within the range 58–60 inches in width and within the range 58–62 inches in length.

Additionally, the piece 30 of stretchable fabric and further piece 58 of stretchable material are cut from a source of material which is velvet.

Also, each finger portion is fitted to the person and will not slip or move because of the four way stretch of the fabric.

The present invention provides a unique and very practical means for protecting the user's hands from the cold while permitting the user's manicured nails to cure.

What I claim is:

1. A manicure glove device for wearing on the hand of a user thereof the device comprising:

a main portion for accommodating the palm of the hand;

a plurality of finger portions extending from said main portion, each finger portion of said plurality of portions having a proximal and a distal end for receiving therein a finger of the hand;

each of said distal portions defining an opening such that a fingernail of the finger protrudes therethrough;

the glove device being fabricated from a piece of stretchable fabric;

said main portion including:

a first and a second end and a first and a second side;

said first end of said main portion defining an aperture for the insertion therein of the hand of the user;

a thumb portion extending from said main portion, said thumb portion having a first and a second extremity for receiving therein a thumb of the hand;

said second extremity defining an orifice such that a thumbnail of the thumb protrudes therethrough;

said thumb portion being disposed adjacent to said second side of said main portion;

a seam for securing said thumb portion to said main portion, said thumb portion being fabricated from a further piece of said stretchable fabric;

said piece of stretchable fabric being a fabric which is stretchable in a first and second direction, said first and second directions being opposite to each other said fabric also being stretchable in a third and a fourth direction, said third and fourth directions being opposite to each other, said first and second directions being normal to said third and fourth directions;

said piece of stretchable fabric including:

a polyester within the range 85–95% by weight; and a spandex within the range 5–15% by weight.

2. A manicure glove device as set forth in claim 1 wherein said plurality of finger portions extend from said second end of said main portion.

3. A manicure glove device as set forth in claim 1 wherein said first side of said main portion includes:

a seam.

4. A manicure glove device as set forth in claim 1 further including:

a thumb portion extending from said main portion, said thumb portion having a first and a second extremity for receiving therein a thumb of the hand;

said second extremity defining an orifice such that a thumbnail of the thumb protrudes therethrough.

5. A manicure glove device as set forth in claim 1 wherein said plurality of finger portions are integral with said main portion, said main portion and said plurality of finger portions being fabricated from said piece of stretchable fabric.

6. A manicure glove device as set forth in claim 1 wherein each finger portion of said plurality of finger portions further includes:

a first and a second seam, each of said first and second seams extending from said proximal to said distal end of said finger portion.

7. A manicure glove device as set forth in claim 1 including:

a further piece of stretchable fabric which includes:

a polyester within the range 85–95%, by weight; and a spandex within the range 5–15% by weight.

8. A manicure glove device as set forth in claim 1 further including:

a source of material;

said source of material being within the range 58–60 inches in width; and within the range 58–62 inches in length, said piece of stretchable fabric being cut from said source of material.

9. A manicure glove device as set forth in claim 1 further including:

a source of material;

said source of material being within the range 58–60 inches in width; and within the range 58–62 inches in length, said further piece of stretchable fabric being cut from said source of material.

10. A manicure glove device as set forth in claim 1 wherein said piece of stretchable fabric is cut from a source of material which is velvet.

11. A manicure glove device as set forth in claim 1 wherein said further piece of stretchable fabric is cut from a source of material which is velvet.

* * * * *